US005214992A

United States Patent [19]

Mohr

[11] Patent Number: 5,214,992

[45] Date of Patent: Jun. 1, 1993

[54] APPARATUS FOR CUTTING STACKED, SHEET-LIKE MATERIAL HAVING A FRONT PUSHER FOR ALIGNING THE MATERIAL AT A FEED UNIT

[76] Inventor: Wolfgang Mohr, Hundshager Weg 42, D-6238 Hofheim/Taunus, Fed. Rep. of Germany

[21] Appl. No.: 645,195

[22] Filed: Jan. 24, 1991

[30] Foreign Application Priority Data

Jan. 25, 1990 [DE] Fed. Rep. of Germany ..... 4002102

[51] Int. Cl.[5] ..... B26D 7/06

[52] U.S. Cl. ..... 83/268; 83/157; 83/278; 83/282; 83/468.6; 83/934

[58] Field of Search ..... 83/153, 268, 269, 271, 83/278, 282, 934, 468.6, 378, 157

[56] References Cited

U.S. PATENT DOCUMENTS

| | | | |
|---|---|---|---|
| 3,165,956 | 1/1965 | Thumim | 83/268 |
| 3,424,044 | 1/1969 | Thumim et al. | 83/268 |
| 4,445,409 | 5/1984 | Mohr et al. | 83/157 |
| 4,505,173 | 3/1985 | Hartlage | 83/934 |
| 4,850,257 | 7/1989 | Mohr | 83/93 |
| 4,922,773 | 5/1990 | Ito | 83/934 |

FOREIGN PATENT DOCUMENTS

| | | | |
|---|---|---|---|
| 0224803 | 7/1985 | Fed. Rep. of Germany | 83/934 |

*Primary Examiner*—Hien H. Phan

*Attorney, Agent, or Firm*—Robert P. Simpson; Michael L. Dunn

[57] ABSTRACT

The invention provides an apparatus for cutting stacked, sheet-like material, having a table (3) for receiving the material to be cut, a cutting blade (7) movable perpendicularly to the plane of the table, a press beam (8) arranged adjacent to this cutting blade (7) and lowerable onto the material to be cut, and also a plate-shaped front pusher (12) for aligning the material at the feed unit, which front pusher (12) can be brought into contact with the front face of the material to be cut, allowing the material to be cut to be aligned at the feed unit without removing or moving the cut material (5); provision is also made for the front pusher to be movable at an angle from above the table towards the front face of the material to be cut and, in its lower end position, to be positioned with its abutting surface (14) essentially in the cutting plane (10) of the cutting blade.

13 Claims, 2 Drawing Sheets

FIG.1
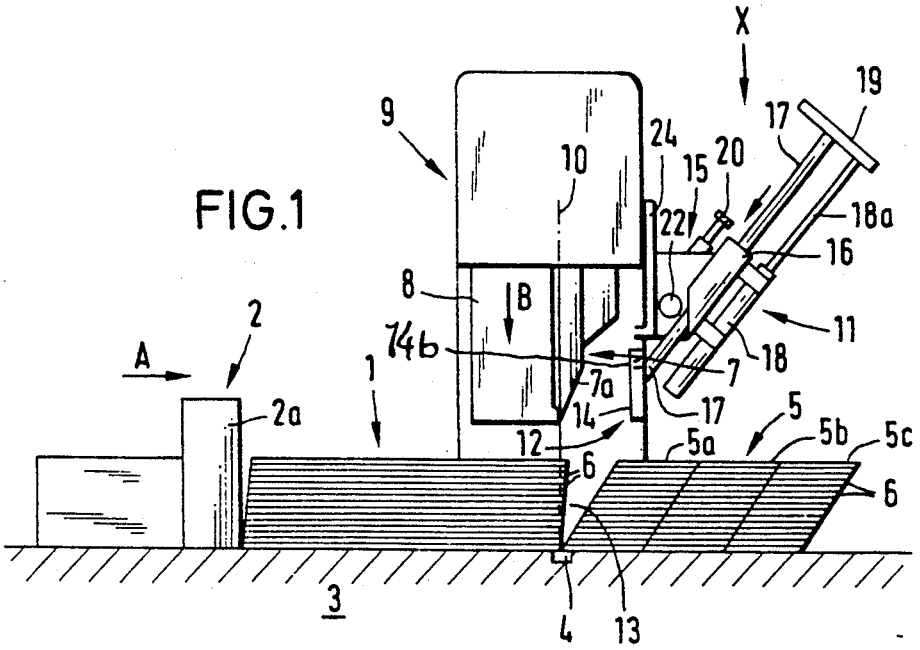
FIG.2
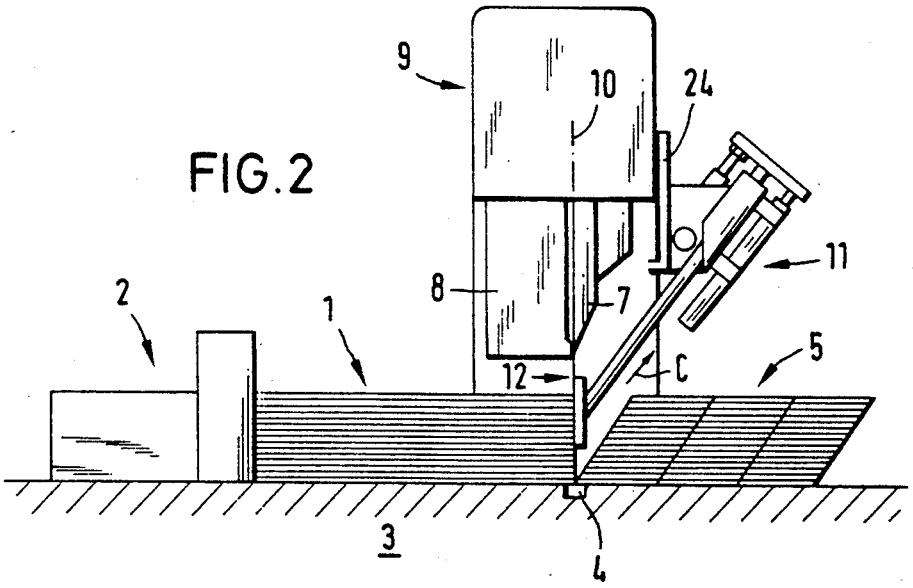
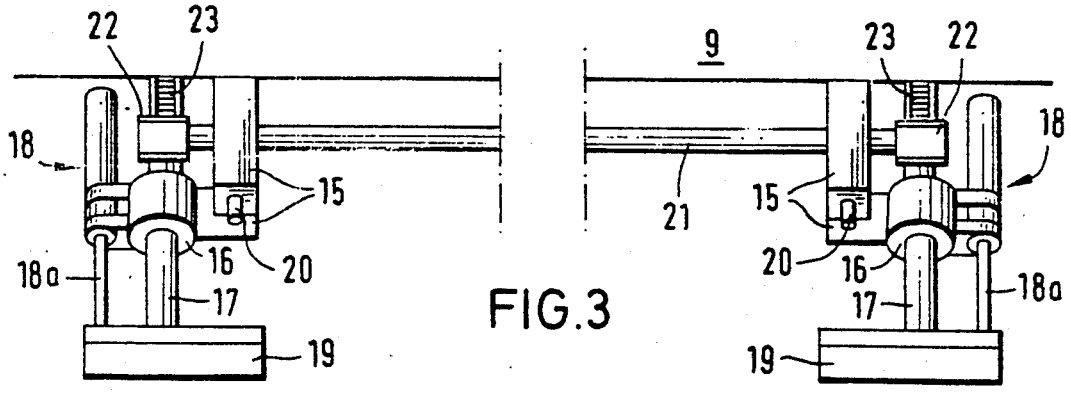
FIG.3

APPARATUS FOR CUTTING STACKED, SHEET-LIKE MATERIAL HAVING A FRONT PUSHER FOR ALIGNING THE MATERIAL AT A FEED UNIT

The invention relates to an apparatus for cutting stacked, sheet-like material, having a table for receiving the material to be cut, a feed unit for the material to be cut, a cutting blade movable perpendicularly to the table plane, a press beam arranged adjacent to this cutting blade and lowerable onto the material to be cut, and also a plate-shaped front pusher for aligning the material at the feed unit, which front pusher can be brought into contact with the front face of the material to be cut.

In order to ensure exact separation of a stack of material to be cut in the area of the predetermined line of cut, it is absolutely essential that this stack of material to be cut is present in a precisely aligned manner. Such separation is ensured, for example, by placing the stack against the feed unit and a side stop.

After the press beam is lifted following a cut, the stack to be cut is relieved below the press beam. Depending on the nature of the material to be cut, this leads to a more or less pronounced movement, in particular of the top sheet layers of the stack of sheet material to be cut, away from the feed unit. Even when the material to be cut is fed at a feed rate permitting industrial production, the top sheet layers of the stack to be cut, in particular when it has a low specific weight and/or smooth surface, cannot be prevented from "running away" from and thus losing contact with the feed unit when the same is stopped.

EP-0,056,874 A2 discloses an apparatus of the type mentioned at the beginning. In this apparatus, the table is of two-piece design; a rear table serves to receive the material to be cut, a front table to receive the cut material. The front table and rear table are movable for forming a gap between them so that the scrap material collecting during marginal and intermediate cuts can be disposed of through this gap. The front pusher, which is designed as a straightedge and is arranged in its inoperative position below the table, is swung into a vertical position through the gap, as a result of which the material to be cut extending up to the front edge of the rear table is pushed against the feed unit extending over the width of the rear table. The straightedge can thus become effective only when front and rear table are moved apart and then only in a plane running through the front edge of the rear table parallel to the cutting plane of the cutting blade. The solution described cannot therefore be used in principle in apparatuses of the said type in which the table is of one-piece design.

EP-0,242,763 A2 discloses an apparatus for cutting stacked, sheet-like material in which a front table and a rear table can likewise be moved apart for forming a gap between them so that the scrap material can be disposed of through this gap. The apparatus has a straightedge—with a function different from the straightedge described above—which, when the gap is closed, is arranged below the front table in the area of the parting surface of front and rear table and, when the gap is being opened, is moved into a working position in which it bears over the entire length of the parting surface against the rear edge of the front table and is perpendicular to the table plane. The straightedge serves the purpose of pushing the set cut last, projecting above the rear edge of the front table, completely onto the front table, and, during the subsequent intermediate cut, it at the same time prevents in particular brittle material to be cut from being flung onto the front table. Finally, it has the function of an aligning surface for the set cut last, which is displaced within itself on account of the geometry of the cutting wedge of the cutting blade. The alignment is effected by means of a front pusher which is pivotably mounted in the front table and aligns the set at the straightedge by an appropriate pivoting movement. It is necessary to position the front pusher differently in accordance with the extension of the respective cut set in the feed direction.

The object of the present invention is to develop further an apparatus of the said type in such a way that alignment of the material to be cut at the feed unit is possible even without removing or moving the cut set.

This object is achieved in that the front pusher is movable at an angle from above the table towards the front face of the material to be cut and, in its lower end position, is positioned with its abutting surface essentially in the cutting plane of the cutting blade. By the movement of the front pusher at an angle from above the table, with a motional component in the opposite direction to the feed direction of the material, it is possible to feed this front pusher into the wedge formed in accordance with the wedge shape of the cutting blade between the material to be cut and the set cut last. The set cut last thus need not be removed in order to be able to align the material to be cut at the feed unit. In addition, it is of advantage in the solution according to the invention that the front pusher assumes an essentially invariable lower end position, namely such an end position in which it is positioned with its abutting surface essentially in the cutting plane of the cutting blade. The term "essential" is intended to outline the fact that the front pusher, with its upper area, can also be inclined slightly in the direction of the material to be cut so that, in its lower end position, it pushes the top sheet layers of the material to be cut against the feed unit to a greater extent than the bottom sheet layers and thus takes into account the fact that the top sheet layers especially "run away" from the feed unit to a greater extent than the bottom sheet layers. In all probability, it will be sufficient for the front pusher to be positioned in its upper area at a maximum of 5° out of the cutting plane of the cutting blade; just 2° to 3° will normally be sufficient. To this end, the front pusher should advantageously be mounted to be adjustable in its angle.

In a particular embodiment of the invention, the front pusher can be brought to bear against the stack to be cut only in the upper area of the same, in particular the top half of the stack. The invention is not restricted to a one-piece design of the table; it can likewise be used in the two-piece table design described above. The length of the front pusher should conveniently correspond virtually to the length of the cutting blade in order thus to ensure alignment of the material to be cut over the entire width of a stack of material to be cut which has the maximum dimension relative to the apparatus.

In a particular embodiment of the invention, provision is made for the front pusher to be mounted in a portal frame of the apparatus on the side of the portal frame facing the material to be cut, which portal frame is allocated to the cutting blade and the press beam. Bearing flanges are conveniently connected at a distance from one another to the portal frame, which bearing flanges each have a bearing bush for a guide rod displaceable by a power-transmission means, the guide rods accommodating at their lower ends the front pusher positioned parallel to the cutting plane of the cutting blade. Two guide rods are advantageously provided whose movement is coupled via a synchronising guide. In addition, a servo cylinder should be connected to each bearing flange, which servo cylinder acts with its piston rod on an extension connected to the upper end of the allocated guide rod, an adjustable stop projecting into the path of movement, directed downwards, of the extension. In this way, the lower end position of the front pusher can be clearly preset. Since stack heights which are quite different have to be cut in the cutting sequence, a further development of the invention provides for the bearing flanges to be arranged to be vertically adjustable in the portal frame and thus also allows the end position of the front pusher to be vertically adjusted.

The front pusher conveniently oriented in its entire adjusting range parallel to the cutting plane can in principle be made of any material. However, it is considered to be advantageous when it is designed to be elastic in the area of its abutting surface. In addition, it can be provided with air nozzles in the area of its abutting surface, which air nozzles are conveniently activated until the front pusher bears against the stack to be cut and simplify the alignment operation on account of the fact that they feed air between at least the top sheet layers of the stack of material to be cut.

Further features of the invention are described with reference to the figures and in the subclaims, all individual features and all combinations of individual features being essential to the invention.

In the figures, the invention is shown by way of example with reference to an embodiment without being restricted to the same. In the drawing:

FIG. 1 shows, in a side view, a schematic representation of the apparatus according to the invention having a front pusher located in the upper end position, FIG. 2 shows a representation according to FIG. 1 having a front pusher located in the lower end position, and FIG. 3 shows a view X according to FIG. 1 of a part of the mechanism for actuating the front pusher.

Figure 4:
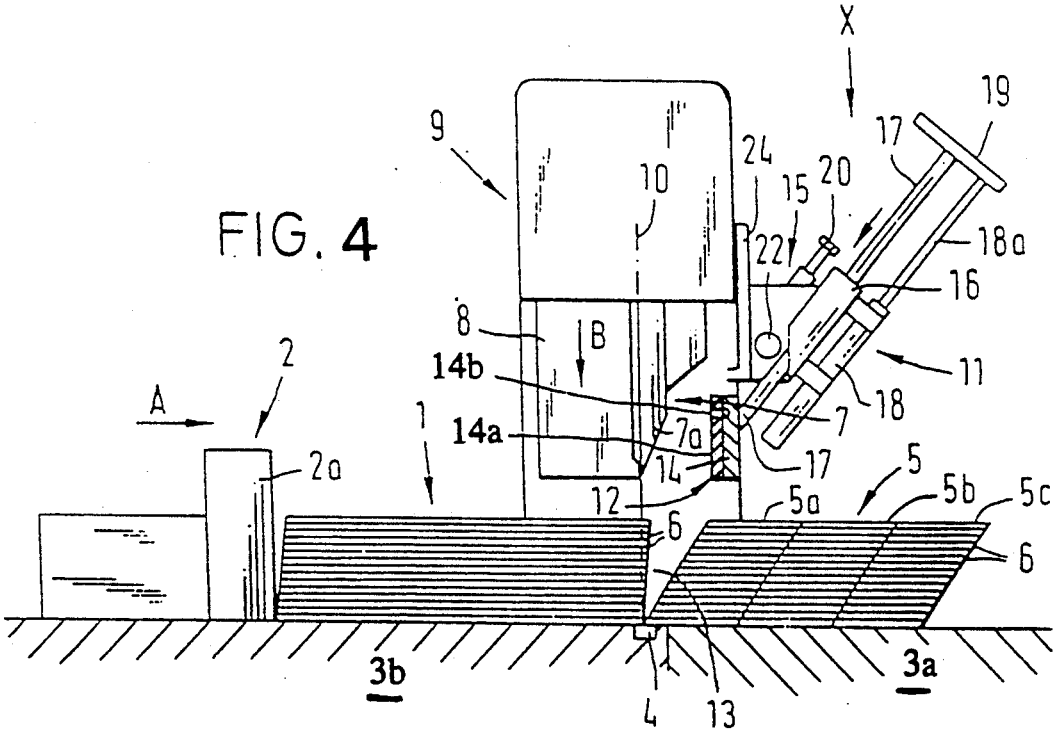
FIG. 4 shows another embodiment of the invention.

FIGS. 1 and 2 show greatly simplified a guillotine-type cutting machine for cutting paper, cardboard or the like having the elements essential to the invention for aligning the material 1 to be cut at a feed unit 2. In a known manner, the guillotine-type cutting machine has a table 3 having a cutting strip 4 let into the machine and extending over the entire width of the table 3. The feed unit 2 having the feed saddle 2*a* likewise extends over the entire width of the table 3. This feed saddle 2*a* can be moved in the direction of arrow A, which results in the fundamental direction of movement of the material to be cut during the course of cutting. Viewed in feed direction A behind the cutting strip 4, the cut material 5 is shown in the form of three sets 5*a*, 5*b* and 5*c* displaced within themselves. A cutting blade 7 is arranged above the cutting strip 4. In the figure, the cutting blade 7 is shown in the raised position from which it can be lowered in the direction of arrow B until it comes into contact with the cutting strip 4. Provided adjacent to the cutting blade 7 is a press beam 8 which can likewise be lowered from the raised position shown in FIG. 1 in arrow direction B onto the material 1 to be cut. The cutting blade 7 and press beam 8 are guided in a portal frame 9 of the guillotine-type cutting machine, which portal frame 9 encloses the cutting blade 7 and press beam 8 at the top and at the side. The cutting plane of the cutting blade 7 is illustrated by the reference numeral 10, which cutting plane runs perpendicularly to the table plane and through the cutting strip 4.

To cut a set 5*a*, the material to be cut is fed by means of the feed unit 2 until the material to be cut protrudes to the desired thickness beyond the cutting plane 10. The press beam 8 is then lowered onto the material to be cut, the individual sheet layers being compressed beneath the press beam 8. The cutting blade 7 is then lowered, and during cutting the set 5*a* is separated from the remaining stack of material 1 to be cut, the set 5*a* being displaced within itself in a parallelogram shape as a result of the configuration of the cutting blade in the lower area in the form of a wedge 7*a*. After the cutting blade 7 returns into its top inoperative position, the press beam 8 is also moved again into its top inoperative position, in the course of which this stack of material 1 to be cut, on account of the relief of the area of the same which is compressed until then by the press beam 8, runs away slightly from the feed saddle 2*a*, in particular in the area of the top sheet layers 6, and thus is no longer exactly in contact there. This state is illustrated in FIG. 1, although three cut sets 5*a*, 5*b* and 5*c* are already shown there.

According to the invention, a device 11 is now provided for aligning the stack of material 1 to be cut at the feed unit 2, which stack is slightly displaced within itself after the press beam 8 is raised. This device 11 has as an essential component a movable front pusher 12 arranged below the cutting blade 7 and extending essentially over the entire length of the cutting blade 7. This front pusher 12 is designed as a vertically orientated plate which can be moved at an angle above the table 3 with a horizontal motional component in the opposite direction to the feed direction A of the material against the front surface of the material 1 to be cut. The lower end position of the front pusher 12 is selected in such a way that its abutting surface 14 coincides with the cutting plane 10 in the lower end position of the front pusher 12, and thus the latter, when lowered into its lower end position, aligns the stack 1 of material to be cut at the feed saddle 2*a* of the feed unit 2, which stack 1 of material to be cut is displaced slightly within itself. Such a state is shown in the representation in FIG. 2; the front pusher 12 can be moved back again from its illustrated position in arrow direction C into its upper end position.

In detail—see also the representation in FIG. 3—two bearing flanges 15 are connected at a distance from one another to the horizontal section of the portal frame 9, which bearing flanges 15 each have a bearing bush 16 for a guide rod 17 displaceable in its longitudinal direction, these guide rods 17 accommodating at their lower ends the front pusher 12 apparent only in the representation in FIGS. 1 and 2 and positioned parallel to the cutting plane 10 of the cutting blade 7. Furthermore, a pneumatically acting servo cylinder 18 is connected to each bearing flange 15, which servo cylinder 18 acts with its piston rod 18*a* on a plate-shaped extension 19 connected to the upper end of the allocated guide rod 17. A stop 20 which can be screwed into the bearing flange 25 and is thus adjustable and defines the lower end position of the front pusher 20 projects into the path of movement, directed downwards, of the respective extension 19. Finally, a synchronising shaft 21 is rotatably mounted in the two bearing flanges 15, the two ends of which synchronising shaft 21 are each provided with a gear 22, which gears 22 mesh with toothed-rack sections 23 of the guide rods 17. The bearing flanges 15 and thus the front pusher 12 can be positioned vertically via vertical guides 24 connected to the portal frame 9.

It can be gathered from the representation in FIGS. 1 and 2 that the guide rods 17 for the front pusher 12 are inclined approximately at an angle of 40° to the vertical, from which the infeed direction of the front pusher 12 results. On account of this direction of movement at an angle from above, the front pusher, after a cut is made, can be moved from above the cut material 5 into the V-shaped gap resulting between the set 5*a* cut last and the stack 1 of material to be cut without the cut sets having to be removed beforehand. As shown in FIGS. 1 and 2, it is quite sufficient for the front pusher 12 to be placed against the stack 1 to be cut only in the area of its top half, since displacements of the individual sheets 6, which displacements impair the cutting result, take place only in the area of the top sheet layers. The invention is not restricted either in so far as the front pusher 2 is fed into the gap at the angle shown or in so far as the table is designed in one piece. The invention can also be used perfectly well in the case of a two-piece table which, from the beginning, enables the cut material 5 to be moved from the material 1 to be cut by moving the table part allocated to the cut material 5 and thus enables the space between the cut material 5 and the material 1 to be cut to be enlarged.

I claim:

1. Apparatus for cutting stacked, sheet-like material, having a table for receiving the material to be cut, a feed unit for feeding the material to be cut onto the table, a cutting blade movable perpendicularly to a table plane, a press beam arranged adjacent to this cutting blade and lowerable onto the material to be cut, and also a plate-shaped front pusher for aligning the material at the feed unit, which front pusher is operatively arranged to be brought into contact with a front face of the material to be cut, characterized in that the front pusher (12) is movable at an acute angle relative to said cutting blade from above the table (3) towards the front face (13) of the material (1) to be cut and, in a lower end position, is positioned with an abutting surface (14) essentially in a cutting plane (10) of the cutting blade (7).

2. Apparatus according to claim 1, characterized in that the front pusher (12) is operatively arranged to be brought to bear against the stack of material (1) to be cut only in the upper area of the same, in particular the top half of the stack (1).

3. Apparatus according to claim 1, characterised in that the table is of one-piece design.

4. Apparatus according to claim 1, characterized in that the table is of two-piece design, having a rear table (3*b*) for receiving the material to be cut and a front table (3*a*) for receiving the cut material, in which arrangement the front table and rear table are operatively arranged to be moved apart for forming a gap between them.

5. Apparatus according to claim 1, characterized in that the front pusher (12) is mounted to a side of a portal frame (9) of the apparatus and arranged such that the pusher is facing the material (1) to be cut, which portal frame (9) contains the cutting blade (7) and the press beam (8).

6. Apparatus according to claim 5, characterized in that bearing flanges (15) are connected at a distance from one another to the portal frame (9), which bearing flanges (15) each has a bearing bush (16) for a guide rod (17) displaceable by a power-transmission means, the guide rods (17) accommodating at their lower ends the front pusher (12) positioned parallel to the cutting plane (10) of the cutting blade (7).

7. Apparatus according to claim 6, characterised in that two guide rods (17) are provided whose movement is coupled via a synchronising guide (21, 22, 23).

8. Apparatus according to claim 6, characterised in that a servo cylinder (18) is connected to each bearing flange (15), which servo cylinder (18) acts with its piston rod (18*a*) on an extension (19) connected to the upper end of the allocated guide rod (17), an adjustable stop (20) projecting into the path of movement, directed downwards, of the extension (19).

9. Apparatus according to claim 1, characterised in that the length of the front pusher (12) corresponds virtually to the length of the cutting blade (7).

10. Apparatus according to claim 1, characterised in that the front pusher (12) is positioned with its upper area slightly out of the cutting plane (10) of the cutting blade (7) in the direction of the material (1) to be cut.

11. Apparatus according to claim 1, characterized in that the front pusher (12) is designed to be elastic (14*a*) in the area of its abutting surface (14).

12. Apparatus for cutting stacked, sheet-like material, having a table for receiving the material to be cut, a feed unit for feeding the material to be cut onto the table, a cutting blade movable perpendicularly to a table plane, a press beam arranged adjacent to this cutting blade and lowerable onto the material to be cut, and also a plate-shaped front pusher for aligning the material at the feed unit, which front pusher is operatively arranged to be brought into contact with a front face of the material to be cut, characterized in that the front pusher (12) is movable at an angle from above the table (3) towards the front face (13) of the material (1) to be cut and, in a lower end position, is positioned with an abutting surface (14) essentially in a cutting plane (10) of the cutting blade (7), further characterized in that bearing flanges (15) are connected at a distance from one another to the portal frame (9), which bearing flanges (15) each has a bearing bush (16) for a guide rod (17) displaceable by a power-transmission means, the guide rods (17) accommodating at their lower ends the front pusher (12) positioned parallel to the cutting plane (10) of the cutting blade (7), and further characterized in that the bearing flanges (15) are arranged to be vertically adjustable in the portal frame (9).

13. Apparatus for cutting stacked, sheet-like material, having a table for receiving the material to be cut, a feed unit for feeding the material to be cut onto the table, a cutting blade movable perpendicularly to a table plane, a press beam arranged adjacent to this cutting blade and lowerable onto the material to be cut, and also a plate-shaped front pusher for aligning the material at the feed unit, which front pusher is operatively arranged to be brought into contact with a front face of the material to be cut, characterized in that the front pusher (12) is movable at an angle from above the table (3) towards the front face (13) of the material (1) to be cut and, in a lower end position, is positioned with an abutting surface (14) essentially in a cutting plane (10) of the cutting blade (7) characterized in that the front pusher (12) is provided with air nozzles in the area of its abutting surface (14).

* * * * *